US005799741A

United States Patent [19]

Kosobrodov et al.

[11] Patent Number: 5,799,741

[45] Date of Patent: *Sep. 1, 1998

[54] METHOD OF CUTTING AND A CUTTING ROTATIVE BIT

[75] Inventors: Yuriy Kosobrodov, Los Angeles; Vincent Jue, Rilling Hills East, both of Calif.

[73] Assignee: Champion Equipment Corp., Paramount, Calif.

[ * ] Notice: The term of this patent shall not extend beyond the expiration date of Pat. No. 5,520,444.

[21] Appl. No.: 606,918

[22] Filed: Feb. 26, 1996

[51] Int. Cl.[6] ..... E21B 10/16; E21C 35/18

[52] U.S. Cl. ..... 175/57; 175/350; 175/374; 299/106

[58] Field of Search ..... 175/57, 329, 325.3, 175/408, 404, 350, 374; 299/106

[56] References Cited

U.S. PATENT DOCUMENTS

| | | | |
|---|---|---|---|
| 4,333,540 | 6/1982 | Daniels et al. | 175/329 |
| 4,445,580 | 5/1984 | Sahley | 175/404 |
| 4,538,690 | 9/1985 | Short, Jr. | 175/329 |
| 4,553,615 | 11/1985 | Grainger | 175/329 |
| 4,640,375 | 2/1987 | Barr et al. | 175/410 |
| 4,751,972 | 6/1988 | Jones et al. | 175/329 |
| 5,341,890 | 8/1994 | Cawthorne et al. | 175/374 |
| 5,520,444 | 5/1996 | Kosobrodov et al. | 299/106 |

*Primary Examiner*—Frank Tsay

*Attorney, Agent, or Firm*—Ilya Zborovsky

[57] ABSTRACT

A cutting, self-rotating, and self-sharpening tool has a rotatable cutting element, generally circular, which is mounted and displaced so that cutting element has an attack angle between 90° and 120°, and a skew angle between 5° and 40°. The cutting element has a convex front face and relief and rake angles that vary along the perimeter of the cutting edge.

16 Claims, 6 Drawing Sheets

Mrot
E
D
Qrot
Q
A
B
C d
L
C
T
β
5c
Δδ
Δγ
δ
γ
Dout
p

DIRECTION OF BIT MOTION
Kerf
5b
α

METHOD OF CUTTING AND A CUTTING ROTATIVE BIT

BACKGROUND OF THE INVENTION

The present invention generally relates to a method and design of cutting and cutting rotative bits, which can be used for excavation, planing and drilling of rock and soil and other non-metallic brittle materials, for destruction, production and treatment of construction materials, and which can be mounted on corresponding equipment, intended for cutting and crushing of the above mentioned materials.

Generally, the cutting process mechanism is as shown in FIG. 1. Cutting of a material, like rock, is carried out due to thrust force T and normal component $C_n$ of the cutting force, generated by an equipment drive. Under the action of these forces, the tool simultaneously moves in horizontal and vertical directions generating complicated stresses that overwhelm rock resistance.

Under the action of the force $C_n$, distributed over the bit front face, compressive stresses are formed in the rock which are not large enough for destruction but preload the rock to resist further strain.

Under the action of the force T, shear stress is produced in the rock due to the high level of load concentration generated by the bit's cutting edge. This shear stress provides generation and development of destructive cracks in the brittle material.

At the same time, both forces $C_n$ and T generate a confined zone of superpressurized rock, located next to the bit cutting edge. This so-called kernal is an accumulator of energy which can discharge in an explosive way when accumulated energy exceeds ultimate rock resistance.

Because the previously mentioned destructive cracks propagate from the cutting edge in the direction of lowest resistance, they initially tend toward the open surface of the rock. However, these cracks cannot bypass the enhanced resistance of the volume of the rock compressed by $C_n$. Consequently, the destructive cracks pass around the compressed rock and reach the open surface at a distance L from the bit front face, isolating the stressed volume of rock and separating this chip from the entire rock massif.

Under continuous, combined action of compressive and shear stresses, successive rock chips are separated from the rock mass in a whole or nearly whole condition chiefly due to long, active destructive cracks and kernal explosion after sufficient energy is accumulated to overcome the crack shortfall.

Therefore, in an effective rock cutting process, it is necessary to maintain a significant load concentration at the bit cutting edge. This is provided by a positive relief angle $\delta$ of the bit so that normal force, T, acts only on a thin line of contact between rock and bit cutting edge. This line contact is critical since cutting ability degrades rapidly with relatively small wear in this area. A sizeable width to this contact area greatly decreases stress concentration in the rock and greatly inhibits long crack generation.

The effective cutting bit must have an optimal combination of high cutting ability and high durability of the cutting element, reliable protection from overloading, preservation of the bit positive relief angle, and maintenance of other initial parameters throughout the lifetime of the cutting bit.

A plurality of tools have been developed with the objective of achieving some of the above mentioned qualities.

The first group of rock-destructing tools is comprised of cutting bits with non-rotatable cutting elements. U.S. Pat. No. 1,174,433 discloses a non-rotating cutter which has a convex front face. But it has a positive rake angle; the angle between its longitudinal axis and the cut surface behind a bit (defined as attack angle) is less than 90°. It has a short cutting edge, positive rake angle and small included angle. Compared to the present invention, this bit has low durability and wear resistance and it only can be used for destruction of the soft and not abrasive rock.

U.S. Pat. Nos. 4,538,691 and 4,678,237 disclose non-rotating cutting tools having rock-destructing elements with a flat front face and substantial negative rake angle, providing protection of the bit from overloading due to operation of a lifting force. However, the described bit has a low cutting ability and requires significant thrust force for penetration into rock. Its attack angle does not exceed 90°.

U.S. Pat. Nos. 4,538,690; 4,558,753 and 4,593,777 disclose non-rotating cutting bits, having a rock-destructing element with a concave front face, oriented at a large negative rake angle, which is used to increase bit durability (including protection against overload). However, this bit also has low cutting and penetration ability. The bit is oriented at an attack angle that is less than 90°.

The second group of patented rock-destructing tools is comprised of round bits with symmetrical cutting elements, which can rotate around its own longitudinal axes.

In the first sub-group of these rotating tools, the bits' rock-destructing elements have a conical shape (direct cone) and destroy rock by their convex-shaped back faces, as disclosed, for example, in U.S. Pat. Nos. 3,650,656; 3,807,804 and 4,804,231. Russian Patent 1,671,850-Al discloses the same so-called conical bit type, which has limited contact area, dependent on attack angle, that can be changed from 0° to 90°. Described bits are of a crushing type that operate without generation of long destructive cracks. The bits are oriented at an attack angle which does not exceed 90°. They have convex front and back faces; zero or negative relief angle and positive rake angle. Their self-rotation is not reliable. Therefore they cannot self-sharpen. These bits have significantly higher specific energy requirements for rock destruction compared to the present invention.

The second sub-group of the rotatable tools includes bits, which destroy rock by their front faces, as disclosed, for example, in U.S. Pat. No. 5,078,219. This bit has a convex back face, positive relief angle and an attack angle close to zero. The bit is a cutting tool when its cutting edge is a sharp one. However, the bit design does not protect it against fast dulling. Bit self-sharpening is impossible since there is no correction of the bit's worn area. As discussed previously, a sizeable width of this contact area for normal force, T, greatly reduces cutting ability.

The third sub-group of the rotatable tools is represented by chisel bits, as disclosed, for example, in German patents 3,336,154-A1 and 3,234,521-A1. These bits have a replaceable cutting sleeve of a tubular chisel shape with a sharpened front end. The bits have a rather small included angle, a sizeable positive rake angle and a small relief angle. Therefore, these bits have low durability and wear resistance and they can only be applied for destruction of soft, not abrasive rock. Compared to the present invention, the bits have an attack angle much less than 90°, a front face which is concave, a back face which is convex, and the bit cannot self-sharpen.

SUMMARY OF THE INVENTION

Accordingly, it is an object of the present invention to provide a method of cutting and a cutting rotative bit, which avoids the disadvantages of the prior art.

More particularly, it is an object of the present invention to provide a method of cutting and a cutting rotative bit which ensures high durability and maintenance of the bit's high initial cutting ability for the entire service life, independent of normal bit wear along engagement surfaces.

In keeping with these objects and with others which will become apparent hereinafter, one feature of the present invention resides, briefly stated, in a method of cutting in accordance with which a cutting rotative bit is used with a body and a generally circular cutting element or multiple elements, connected with the body wherein the cutting element has a convex front face, and in the inventive method the cutting rotative bit is oriented so that an attack angle of the bit's cutting element exceeds 90°. (Attack angle is the angle between the longitudinal axis of the bit and the cut surface behind the bit).

When the method is performed and the tool is designed in accordance with the present invention, the following advantages are provided:

- Significant cutting ability of the bit, which provides highly efficient destruction of the rock and other similar material;
- Continuous, forced self-rotation of the bit around its own longitudinal axis, which provides increased bit cutting edge length and uniform wear along its back face;
- Continuous, forced self-sharpening of the bit, that maintains the initial positive relief angle, of the bit along its whole cutting edge by grinding away interfering cutting element material along its back face;
- Increased durability of the bit resulting in high bit reliability and longevity and increased range of working material that may be engaged because of highly rational force transmission through the cutting element of the bit. Stress in the brittle cutting element is almost entirely compressive;
- Effective operation of the bit until a large proportion of the cutting element is consumed by normal wear providing long bit service life.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
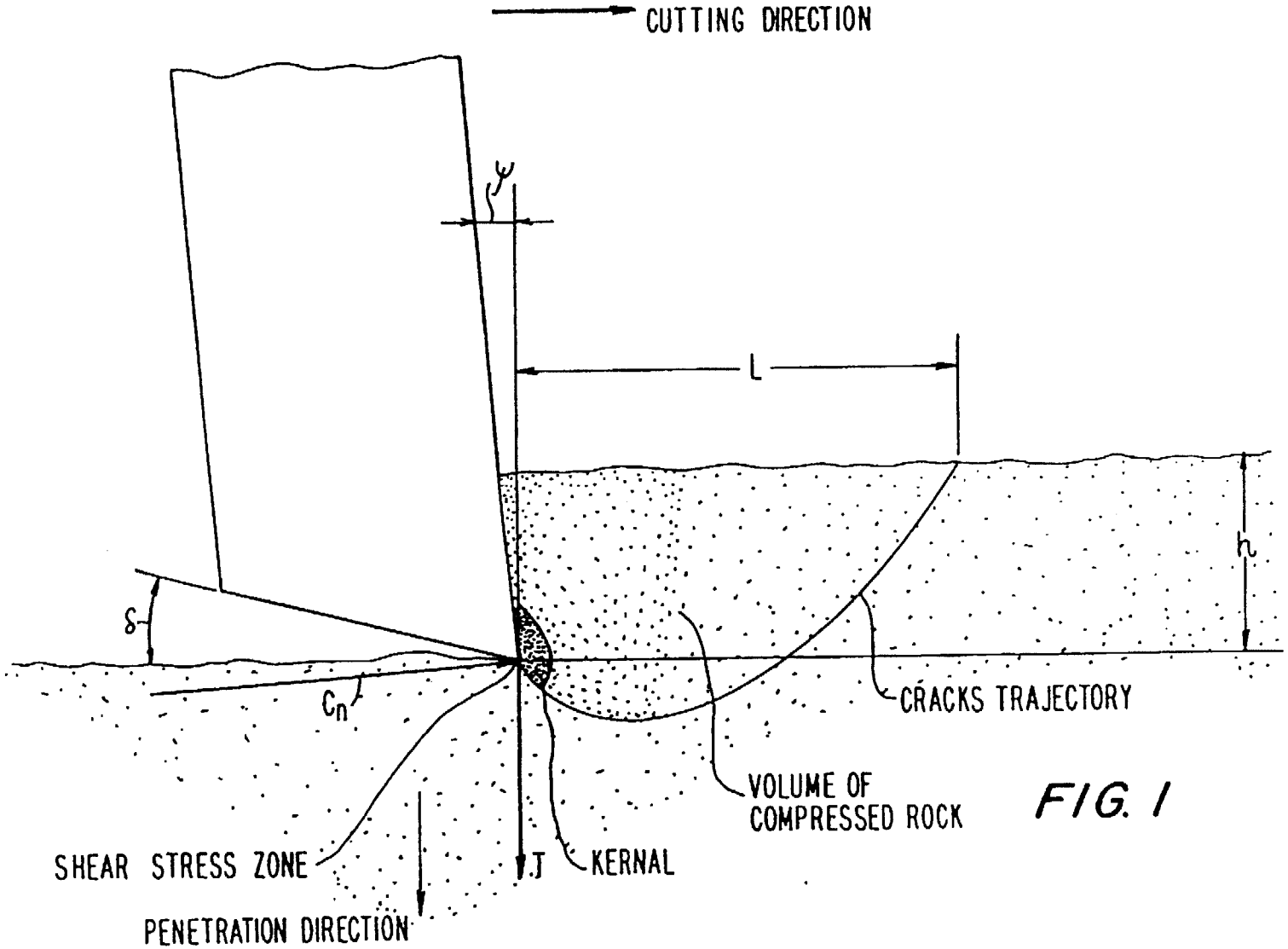
FIG. 1 is a view schematically showing the mechanism of rock destruction.

A cutting tool (FIGS. 2, 3 and 4) in accordance with the present invention has a body which is identified with reference numeral 1 and a cutting element or an insert which is identified with reference numeral 2. The body is further provided with a tail part 3 which contributes to rotation of the bit about its longitudinal axis and can be used to hold the cutting tool.

Figure 2:
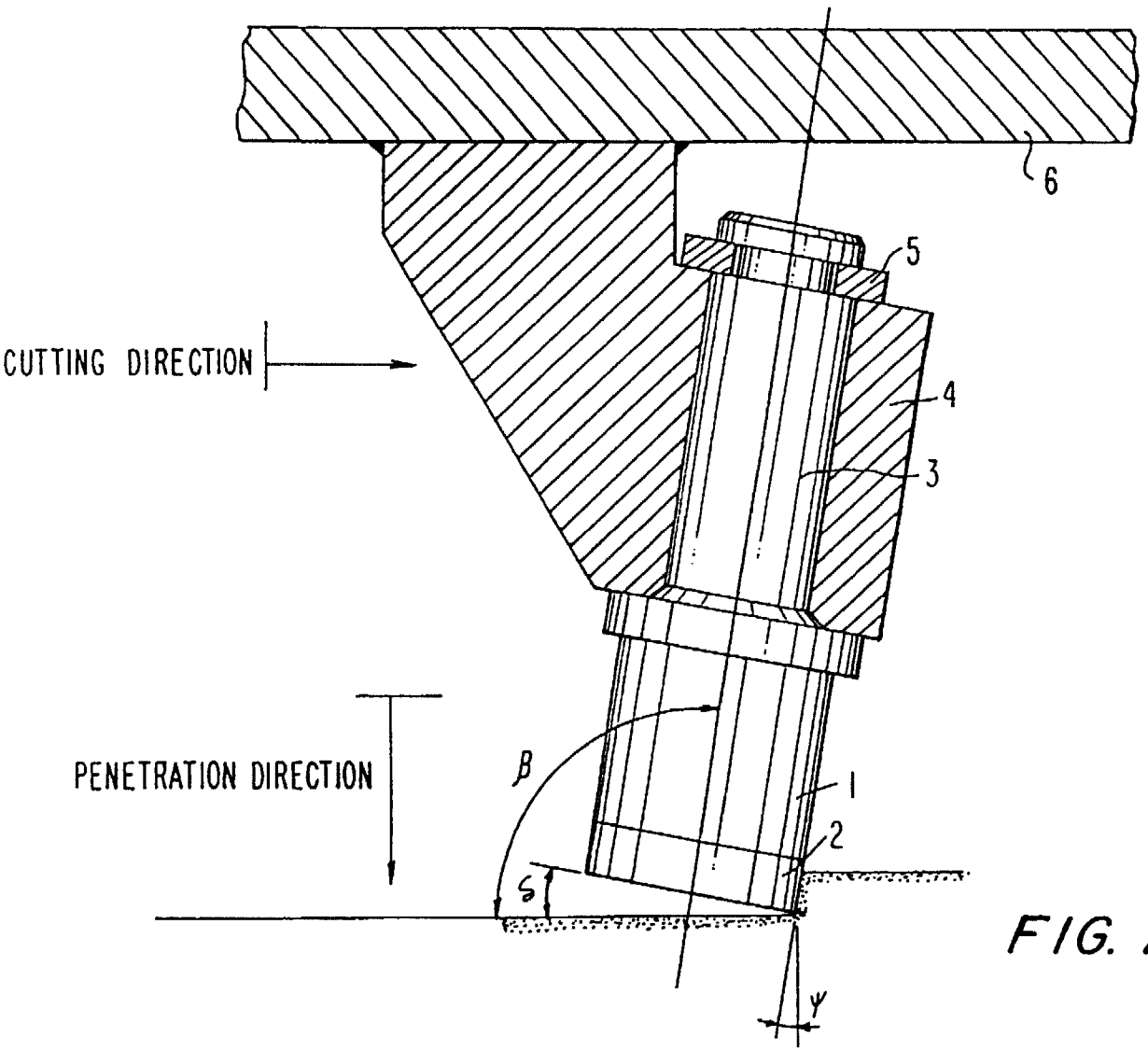
FIG. 2 is a view, showing a cutting device provided with the cutting rotative bit in accordance with the present invention.

As can be seen from FIG. 2, the tail part of the bit is arranged in a tool holder 4 and retained by a retainer 5. The tool holder or a plurality of tool holders are aligned with respect to each other and attached to a cutter support 6. The main angles, providing the spatial orientation of each cutting rotative bit, are determined by mounting of the tool holder to the cutter support as will be discussed hereinbelow. The tail portion 3 of the bit and therefore the cutting rotative bit are held in the tool holder rotatably around its longitudinal axis and fixed in the axial direction.

The cylindrical or conical body is made, as a rule, from alloyed steel, which has a substantial elasticity and strength.

The insert 2 (FIG. 3) is ring-shaped and can be formed as a solid ring or a composite ring, composed of individual segments. The inner opening of the ring can be cylindrical or conical while its surface, which is in contact with the body, may be flat or curved. In other embodiments of this invention, the entire bit can be exclusively made of one material.

Figure 3A:
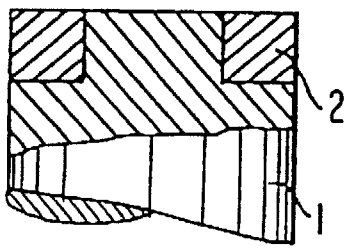
FIG. 3*a* is a view, showing the inventive cutting rotative bit with cutting element, having the front face of a cylindrical shape and back face of a flat shape.
Figure 3B:
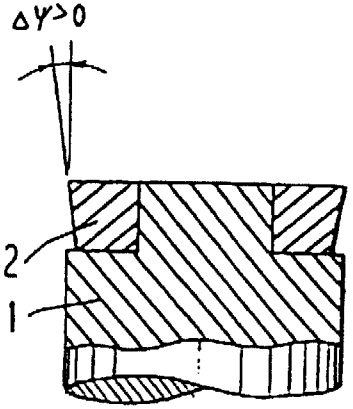
FIG. 3*b* is a view, showing the inventive cutting rotative bit with cutting element, having the front face of an inverse conical shape and back face of a flat shape.
Figure 3C:
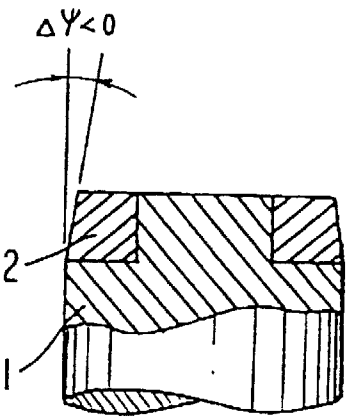
FIG. 3*c* is a view, showing the inventive cutting rotative bit with cutting element, having the front face of a direct conical shape and a back face of a flat shape.
Figure 3D:
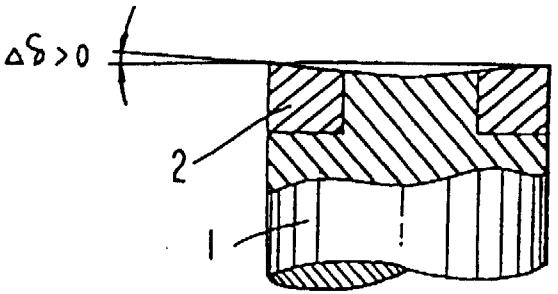
FIG. 3*d* is a view, showing the inventive cutting rotative bit with cutting element, having the front face of a cylindrical shape and a back face of a concave shape.
Figure 3E:
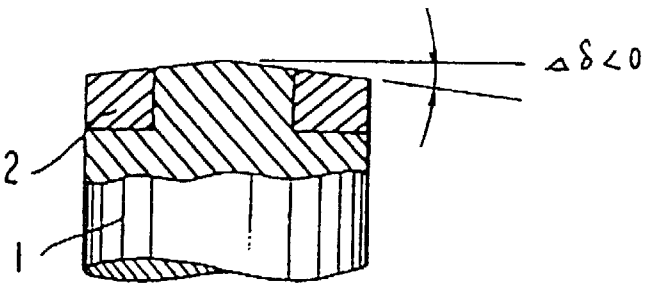
FIG. 3*e* is a view, showing the inventive cutting rotative bit with cutting element, having the front face of a cylindrical shape and a back face of a convex shape.

The upper surface of the insert can be flat, as shown in FIGS. 3*a*, 3*b*, 3*c*. It can also be concave, as shown in FIG. 3*d* or convex, as shown in FIG. 3*e* . The outer surface of the ring which is the front face of the bit always has a convex shape formed by a generatrix of a cylinder, as shown in FIGS. 3*a*, 3*d*, and 3*e*, or direct cone, as shown in FIG. 3*c* or inverse cone, as shown in FIG. 3*b*.

Figure 4B:
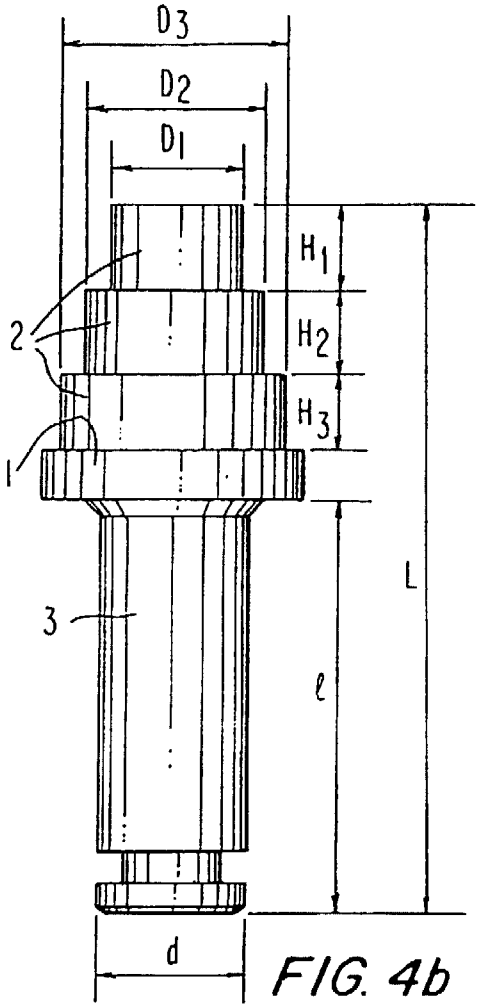
FIG. 4*b* is a view, showing the inventive cutting rotative bit with multiple cutting elements on a stepped cylindrical body.
Figure 4E:
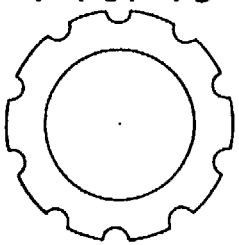
FIG. 4*e* is a view, showing the inventive cutting rotative bit with cutting element, having a daisy shape in cross-section.
Figure 4D:
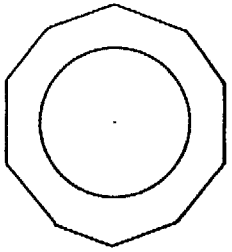
FIG. 4*d* is a view, showing the inventive cutting rotative bit with cutting element, having the polygonal shape in cross-section.
Figure 4C:
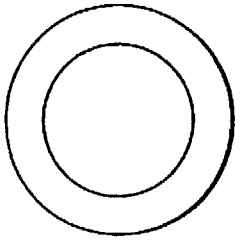
FIG. 4*c* is a view, showing the inventive cutting rotative bit with cutting element, having the round smooth shape in cross-section.
Figure 4A:
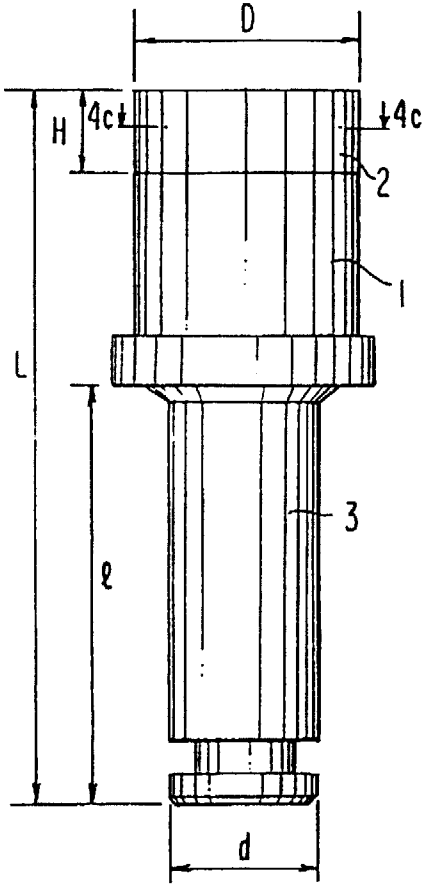
FIG. 4*a* is a view, showing the inventive cutting rotative bit with a simple cutting element on a cylindrical bit body.

Outer contour of the cutting element can be straight one, as shown in FIG. 4*a*, or stepped one, as shown in FIG. 4*b*.

Shape of the cutting element in cross-section can be round, as shown, in FIG. 4*c*, or polygonal, as shown in FIG. 4*d*, or daisy-shaped, as shown in FIG. 4*e*.

The insert, as a rule, is made of hard wear resistant materials, preferably sintered hard alloys of the tungsten carbide group. The convex shape of the front face of the insert is preferable, since the cutting forces are directed toward the center of the ring and are resolved into mainly safe compressive stresses, instead of tensile stresses which are very dangerous for brittle materials like the hard alloys the insert is composed of.

The convex shape of the front face of the bit also contributes to more efficient removal of the destroyed rock from the cutting zone due to dispersing of cuttings to both sides of the bit.

The connection of the insert to the body can be performed by brazing, in particular for the composite ring, with use of high temperature brazing filler metal, or performed with interference for press fit. The ring-shaped insert provides semi-closed containment of brazing materials to ensure durable and reliable joining of the body and insert which is particularly important in condition of dynamic loads. The press fitting on the other hand, eliminates residual thermal stresses which are characteristic of high temperature brazing due to different expansion coefficients of the joined elements.

The solid bits which are not subdivided into the body and insert are recommended for cutting of non-abrasive materials. It must be subjected to a special thermal treatment, for example, isothermic quenching to provide different hardness of the body portion and cutting element portion of the bit.

Figures 5A, 5B, 5C:
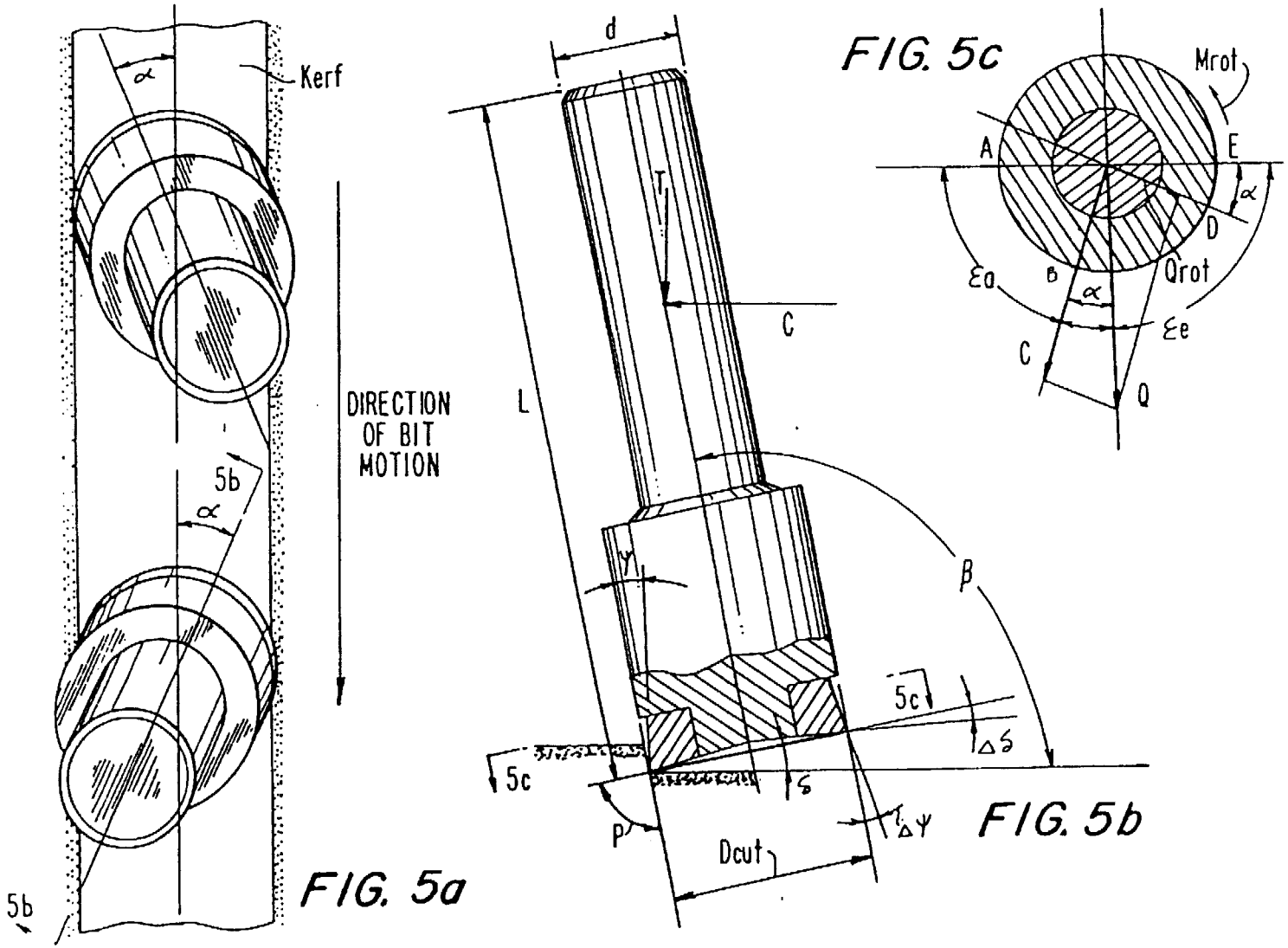
FIG. 5*a* is a plan view of the inventive cutting rotative bit, showing skew angle.
FIG. 5*b* is a view, showing the main longitudinal section of the cutting rotative bit and all vertical plane angles in accordance with the present invention.
FIG. 5*c* is a view, showing cross-section of the inventive cutting rotative bit.
Figure 6:
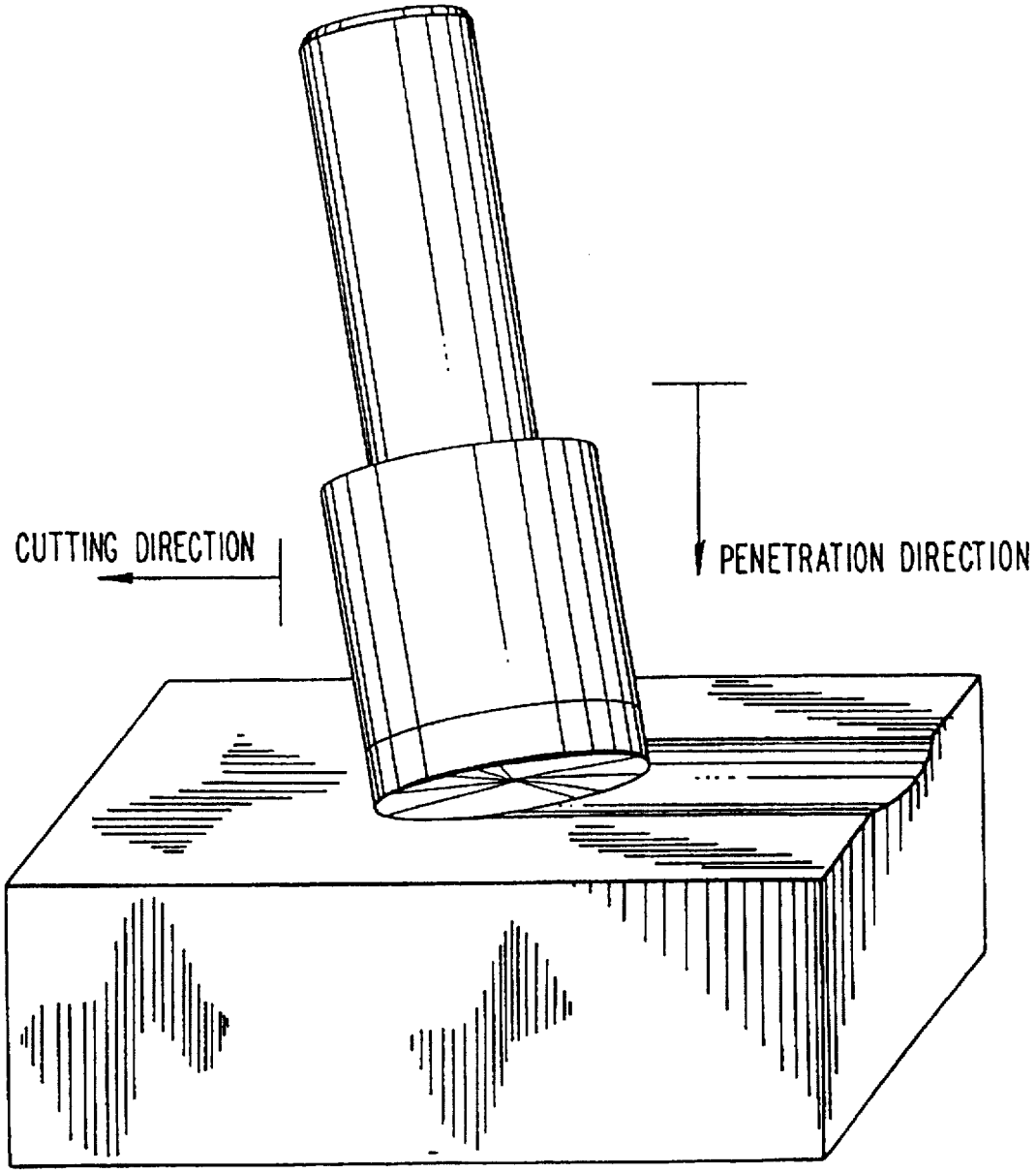
FIG. 6 is a perspective view of the inventive cutting rotative bit while cutting.

The main new feature of the present invention is that the inventive method is performed so that the cutting rotative bit is oriented to the surface of the rock to be cut at an attack angle $\beta$ which exceeds 90°, a shown in FIGS. 2 and 5*b*.

Skew angle a shown in FIGS. 5*a* and 5*c*, is measured in the plane of the cut rock surface and is the angle between the projection of the bit longitudinal axis and the direction of bit motion.

The skew angle determines a cutting force C, providing the rock cutting ($C=Q \cos \alpha$) and rotating (crushing) force $Q_{rot}$, promoting rotation of the bit around its own longitudinal axis ($Q_{rot}=Q \sin \alpha$)The The tool attack angle $\beta$, in combination with tool skew angle $\alpha$ provides favorable conditions for optimization of the main parameters of the tool (including a rake angle $\psi$ and a relief angle $\delta$ at any point of the bit cutting edge).

The spatial orientation of the tool which is determined by attack angle $\beta$ and skew angle $\alpha$ imparts the following properties:

The front face of the bit is the convex surface of the insert, while the back face of the tool is the end surface of the insert;

The rotation of the tool around its longitudinal axis (FIGS. 5*b* and 5*c*) occurs due to rolling of the bit cutting edge along the corresponding surface of the rock under the action of the rotary moment $M_{rot}$. $M_{rot}$ is the couple of the frictional force generated by force $Q_{rot}$ (and thrust force) and tangential force Q.

The direction of the rectilinear motion of the tool does not coincide with the direction of cutting (breaking) of the rock, which is different for each point of the cutting edge of the tool, as shown in FIG. 5*c*.

Instantaneous values of rake angle $\psi_i$ and relief angle $\delta_i$ vary continuously from point to point along bit cutting edge (arc AE, FIG. 5*c*).

At the point B (FIG. 5*c*) the relief angle $\delta_b$ has its maximum positive value. Moving away from the point B to the right and to the left, this angle reduces ($\sin \delta_i=\sin \delta_b \cos \epsilon_i$) and assumes its zero value at point D and a negative value at point E. The geometrical correction of the relief angle of the tool by introducing the positive angle $\Delta\delta$ (FIG. 5*b*; $\Delta\delta=\cos \alpha \sin \beta$) provides a positive relief angle along the whole cutting edge of the bit (the arc AE in FIG. 5*c*). Therefore, this condition, necessary for high rock stress concentration at the cutting edge, is maintained.

Under the condition $|\Delta\delta|=|\delta|$ the relief angle of the tool at the point E is zero. Therefore, on the radial line at Et self-sharpening occur: because of continuous removal of back face material that would interfere with maintaining the positive relief angle along the entire cutting edge, Self-sharpening proceeds around point E at the same time as wear occurs along the remainder of the cutting edge.

At the point B in FIG. 5*c*, the rake angle $\psi_b$ has its maximum negative value. Moving from point B to the right or to the left increases this angle so as to assume i s zero value at the point D and its positive value at the point E. Therefore, at the point S the thrust force per unit length will be maximal, when compared with remaining points of the cutting edge of the too, over the arc AE in FIG. 5*c*. Therefore, the intensity of friction and wear is maximum, at E and, in combination with the zero value of the relief angle, provides conditions which are close to machine tool sharpening. With the introduction of the positive angle of correction $\Delta\psi$, FIG. 5*b*, the effect of self-sharpening is further increased.

The negative rake angle of the tool, which is maximal in central part of the cutting edge, contributes to the self-protection against overloading. A negative rake angle generates a lifting force which lifts the tool from the rock. Such overloading is usually caused by the increase of the hardness of the rock to be broken.

The continuous rotation of the tool around its longitudinal axis is reliable due to the following factors:

Absence of substantial resistance to the rotation along the back face of the tool due to the positive relief angle; and Use of substantial cutting force C (as compared with the thrust force), which is produced by the drive of the cutting equipment to form the significant $Q_{rot}$.

The nature and the axial direction of wear of the tool along the back face in combination with the continuous renewal by self-sharpening to initial values of the relief angle along the whole cutting edge of the tool provides for efficient operation of the tool in the cutting mode until the wear substantially consumes the insert.

The attack angle in accordance with the present invention can be within the range of 90° to 120°. The skew angle can be within the range of 50° to 40°. The rake angle can be within the range of plus 15° to minus 15°. The relief angle can be within the range from 0° to 20°. The included angle can be within the range of 50° to 100°.

It will be understood that each of the elements described above, or two or more together, may also find a useful application in other types of constructions differing from the types described above.

While the invention has been illustrated and described as embodied in a method of cutting and a cutting rotative bit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting self-rotating and self-sharpening tool, comprising a rotatable cutting element; and means for holding said cutting element so that said cutting element has an attack angle exceeding 90°, and a skew angle at least 5°.

2. A cutting self-rotating and self-sharpening tool as defined in claim 1, wherein said cutting element has a convex front face.

3. A cutting self-rotating and self-sharpening tool as defined in claim 2, wherein said convex front face has a shape selected from the group consisting of a cylindrical shape, a direct conical shape and an inverse conical shape.

4. A cutting self-rotating and self-sharpening tool as defined in claim 1, wherein said cutting element has a back face with a shape selected from the group consisting of a convex shape, a concave shape, a flat shape and a combination of said shapes.

5. A cutting self-rotating and self-sharpening tool as defined in claim 1, wherein said cutting element has a longitudinal section with an outer shape selected from the group consisting of a straight shape and a stepped shape.

6. A cutting self-rotating and self-sharpening tool as defined in claim 1, wherein said cutting element has a transverse section with an outer shape selected from the group consisting of a round shape, a polygonal shape and a daisy shape.

7. A cutting self-rotating and self-sharpening tool as defined in claim 1, wherein said cutting element has the attack angle between 90° and 120°.

8. A cutting self-rotating and self-sharpening tool as defined in claim 1, wherein said cutting element has the skew angle between 5° and 40°.

9. A cutting self-rotating and self-sharpening tool as defined in claim 1, wherein said cutting element has a relief angle between −15° and 15°.

10. A cutting self-rotating and self-sharpening tool as defined in claim 1, wherein said cutting element has a relief angle between 0° and 20°.

11. A cutting self-rotating and self-sharpening tool as defined in claim 1, wherein said relief angle has a positive angular correction, providing cutting element self-sharpening, determined from formula $\Delta\delta \leqq \arcsin(\sin\alpha \cos\beta)$, where $\alpha$ is a skew angle, $\beta$ is an attack angle.

12. A method of cutting, comprising the steps of providing a rotatable cutting element; mounting said cutting element by mounting means; and displacing said mounting means so that said cutting element has an attack angle exceeding 90°, and a skew angle.

13. A method as defined in claim 12, wherein said ting includes mounting said cutting element so as to provide the attack angle of said cutting element between 90° and 120°.

14. A method as defined in claim 12, wherein said mounting includes mounting said cutting element so as to provide a skew angle of said cutting element between 10° and 40° for both sides of inclination.

15. A method as defined in claim 12, wherein said mounting includes mounting said cutting element so as to provide a rake angle of said cutting element between −15° and 15°.

16. A method as defined in claim 1, wherein said mounting includes mounting said cutting element so as to provide a relief angle of said cutting element between 0° and 20°.

* * * * *